US005740588A

United States Patent [19]

Strick

[11] Patent Number: 5,740,588

[45] Date of Patent: Apr. 21, 1998

[54] CAGE GIN FEEDING APPARATUS AND METHOD

[75] Inventor: Leo Strick, Greenville, S.C.

[73] Assignee: Lummus Corporation, Columbus, Ga.

[21] Appl. No.: 366,620

[22] Filed: Dec. 30, 1994

[51] Int. Cl.[6] ..... D01B 1/06

[52] U.S. Cl. ..... 19/48 R; 19/64.5

[58] Field of Search ..... 19/58, 59, 60, 19/48 R, 64.5, 41, 44, 42, 40, 39, 53, 50

[56] References Cited

U.S. PATENT DOCUMENTS

| | | | |
|---|---|---|---|
| 88,464 | 3/1869 | Emery | 19/60 |
| 1,201,901 | 10/1916 | West | 19/58 |
| 1,220,959 | 3/1917 | Cox | 19/58 |
| 1,276,355 | 8/1918 | Henry | 19/58 |
| 1,375,985 | 4/1921 | Vardell | 19/58 |
| 1,375,986 | 4/1921 | Vardell | 19/58 |
| 4,441,232 | 4/1984 | Underbrink et al. | 19/48 R |
| 4,934,029 | 6/1990 | Wilkes et al. | 19/48 R |

*Primary Examiner*—Ismael Izaguirre
*Attorney, Agent, or Firm*—Veal & Marsh

[57] ABSTRACT

Maximum separation of the seed cotton locks delivered to a cage roller gin is achieved by a ballistic trajectory that carries the locks over the top of the cage roller to a landing area. In the preferred embodiment, the flight of the locks over the cage roller is induced by a pair of oppositely driven rollers which expel the cotton from between their adjacent surfaces along a common tangential plane offset at an angle above the top of the cage roller. Ambient air is admitted to the relatively large volume plenum from beneath the rollers and a primary flow of air about the cage roller is promoted as the seed cotton overlies the rotating cage such that the air and injected seed cotton locks flow in co-current direction above the cage roller.

21 Claims, 1 Drawing Sheet

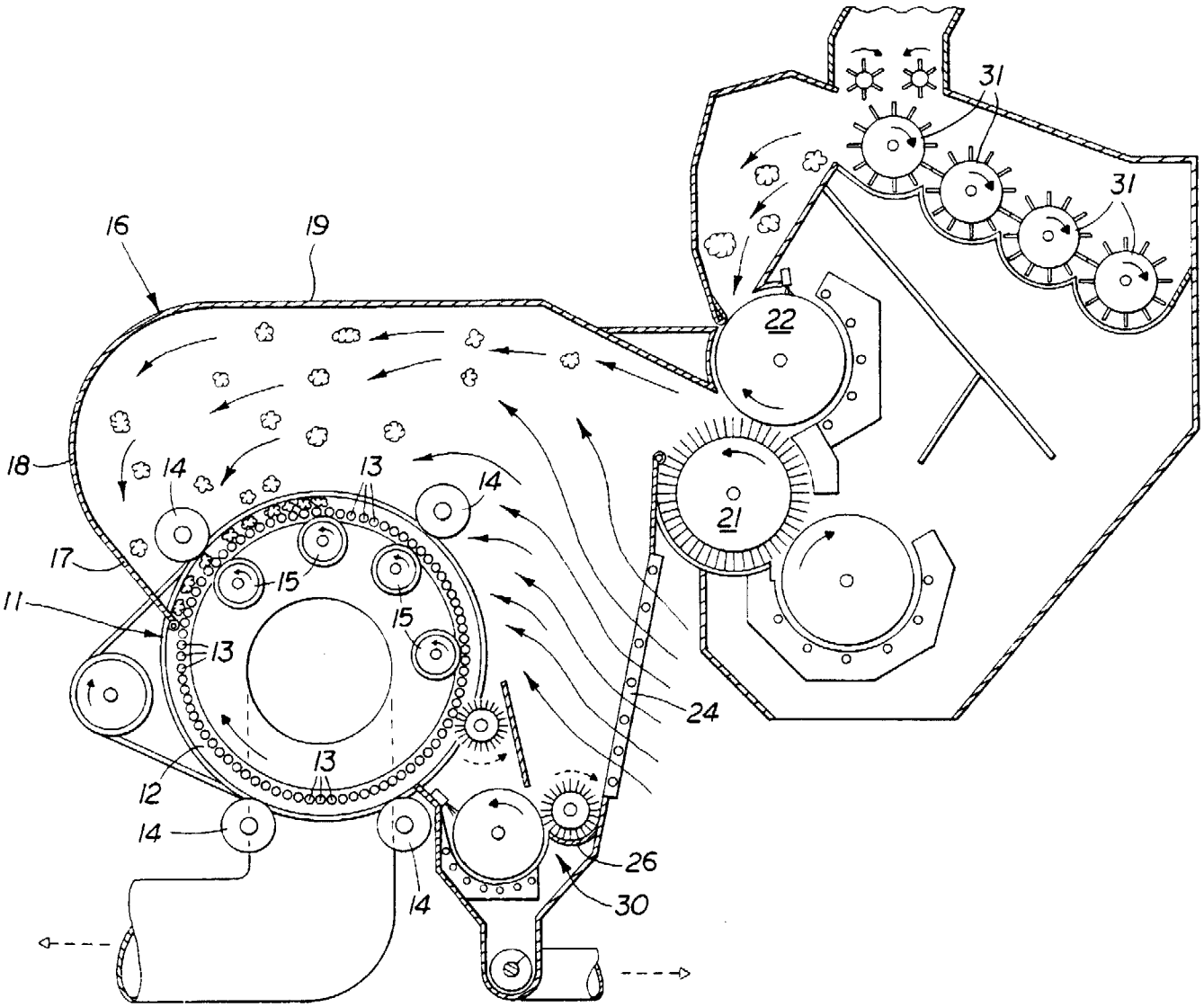
31
31
22
21
24
26
30
14
15
13
19
16
18
17
11
12

CAGE GIN FEEDING APPARATUS AND METHOD

FIELD OF THE INVENTION

The present invention relates to the field of cotton ginning and more particularly to the field of cotton ginning wherein the basic gin is a cage roller type gin. In greater particularity, the present invention relates to a method and apparatus for improving the performance of a cage roller gin by improving the feeding of seed cotton to the gin for ginning.

BACKGROUND OF THE INVENTION

Since the time of Whitney numerous improvements have been made in cotton ginning. In one type of ginning apparatus as described in U.S. Pat. No. 4,441,232, a plurality of cage rollers are rotatably driven in a continuous path. At least one nip roller is positioned in abutting relation to the cage rollers on the side thereof opposite the seed cotton such that fibers extending between the rollers are caught or "nipped" therebetween. A suction source draws air between the cage rollers such that a portion of the fiber of the seed cotton is positively drawn into the nip area. Fibers thus removed from the seed are entrained in the air flow and are withdrawn from the apparatus thereby.

The apparatus as described in the above patent suffers certain constraints in terms of efficiency in that the seed cotton has a tendency to agglomerate such that individual locks of seed cotton are not presented to the nip area and air flow may be blocked beneath an agglomeration such that a large percentage of the locks do not effectively engage the nip roller. Accordingly, attempts have been made to overcome this problem as shown in U.S. Pat. Nos. 4,934,029; 4,984,334; and 5,003,669. While these attempts may in part reduce the magnitude of the problem presented, they do not provide for a highly efficient ginning operation.

SUMMARY OF THE INVENTION

It is the principal object of the invention to improve the efficiency of the cage roller ginning apparatus as is known in the prior art.

A more specific object of the invention is to deliver seed cotton to a cage roller gin in such a manner that an appreciably larger number of second cotton locks are individually distributed on the surface of the cage rollers.

A further object of the invention is to disperse the individual locks of cotton such that a greater initial quantity of fibers extend through the cage roller to be nipped.

In greater particularity, the object of the invention may be accomplished by first separating the locks of cotton and then directing them to the cage rollers ballistically. These and other objects of the invention are accomplished through the use of conventional devices combined in an unconventional and novel manner. Essentially, my invention achieves maximum separation of the locks by delivering them to the cage roller via a ballistic trajectory combined with air currents that carry the locks over the top of the cage rollers to diverse landing areas. In the preferred embodiment, the flight of the locks over the cage rollers is induced by a pair of oppositely driven delivery rollers which expel the cotton from between their adjacent surfaces initially along a common tangential plane offset at an angle above the top of the cage roller. Ambient air is admitted to the relatively large volume plenum from beneath the oppositely driven delivery rollers and a primary flow of air about the cage roller is promoted as the seed cotton overlies the rotating cage such that the air and injected seed cotton locks flow in co-current direction above the cage rollers.

BRIEF DESCRIPTION OF THE DRAWINGS

Apparatus embodying features of my invention and useful in the practice thereof are depicted in the accompanying drawing which form a portion of this disclosure and wherein:

The single figure is a sectional view of a cage gin with my feeding apparatus installed.

DESCRIPTION OF THE PREFERRED EMBODIMENT

Referring to the drawings for a clearer understanding of the invention it may be seen that the cage gin structure is substantially as described in U.S. Pat. No. 4,441,232, which is incorporated herein by reference for the purpose fully describing the operative structure of the gin. As will be appreciated in FIG. 1 the cage 11 includes a pair of cage rings 12 which support a plurality of cage rollers 13 on the inner periphery thereof in adjacent spaced relation. The rings 12 and rollers 13 mounted thereon rotate around an axis passing through the center of the rings 12 parallel to the rollers 13 and may be driven for such rotation by any suitable means such as the motor and sheave with belt as shown. As also noted the axis of rotation is horizontally disposed with the cage being supported on rollers 14. Arranged within the cage is at least one nip roller 15 driven by suitable means (not shown).

A housing 16 defines a plenum about the upper surface of the cage 11 and includes a slide wall 17 which terminates at a lower edge adjacent the cage 11 and extends upwardly and outwardly away from the cage. The line of intersection between the slide wall 17 and the cage 11 is in a region wherein the cage rollers 13 are moving upwardly toward their highest point of rotation. An arcuate wall section 18 is integrated with the top of slide wall 17 and curves upwardly and over the top of the cage 11 where it transitions to a top wall 19 which extends over the top of the cage 11 to the feeding mechanism.

The feeding mechanism includes a high speed doffing brush 21 mounted for driven rotation about an axis parallel to the axis of rotation of the cage 11 and at a height approximating the height of the top of the cage 11. A counter rotating saw cylinder 22 is mounted for driven rotation about a parallel axis and offset slightly horizontally from the doffing brush 21, such that a plane extending parallel to the tangent planes of the opposing surfaces of brush 21 and saw 22, hereinafter referred to as the common tangent plane, is oriented at an angle of about twenty degrees from horizontal. It is contemplated that this angle may vary in other embodiments of the invention depending on the location of the brush 21.

The upper wall 19 extends downwardly at an angle steeper than the tangent plane to a terminating scrollwork 23 adjacent the saw cylinder 22. The scrollwork 23 extends upwardly peripherally of the saw 22 above the tangent plane. The housing 16, also includes a panel 24, subjacent the doffing brush 21 and a scroll 26 at the lower end of the panel which extends beneath a reclaiming saw and brush assembly 30 to adjacent the lower side of cage 11. Accordingly cotton can only be admitted to the plenum above the cage 11 through an opening 27 in the housing 16 between upper wall 19 and panel 24. This opening is aligned with the tangent plane and is further defined by the structures peripheral to the saw 22 and doffing brush 21. Thus cotton is only admitted to the plenum by passing between the saw 22 and doffing brush 21 and then through opening 27.

Upstream of the saw and brush assembly, a series of spiked cylinders 31 condition the seed cotton by partially separating the mass of fiber and seed into individual locks of seed and associated fibers. The saw 22 further separates the locks; however, when the seed cotton is carried between the high speed doffing brush 21 and the saw 22, the individual lock's momentum is greatly increased such that the cotton is ejected along the tangent plane with sufficient force to carry the cotton over the top of the cage 11 to the area on the cage adjacent the slide wall 17. Accordingly, a form of air separation takes place due to the different weights, densities, quantities of fiber and other characteristics of the individual locks which influence their ballistic trajectories after being injected into the plenum. It should be understood that approximately two-thirds of the weight of the seed cotton locks is contained in the seed which vary widely in their individual size. Another factor aiding in the dispersal of the locks is the air flow within the plenum. Panel 24 has a number of perforations therein such that ambient air is admitted to the plenum therethrough responsive to the suction action within the cage. Inasmuch as the cage rollers 13 are closely spaced to one another, a portion of the airstream will be unable to enter between the closest side of the cage and will circulate upwardly and over the cage 11 in substantially co-current flow with the injected seed cotton. As the seed cotton overlays the cage, the path of least resistance to the air flow will be toward the portion of the cage passing beneath the slide wall where cotton has not yet accumulated thus providing increased air flow across the top of the cage. Still another factor aiding in the dispersal of the seed cotton locks on the surface of the cage rollers is that in my preferred embodiment, the top surface of the cage 11 moves toward the doffing brush 21 contrary to the prior art. This accomplishes two novel affects. First, the counter movement of the top surface of the cage 11 and the ballistic trajectory of the seed cotton locks causes a wider separation of successive seed locks landing on the surface of the cage. Secondly, the rotation of the top surface of the cage 11 toward the doffing brush 21 places the seed reclaiming saw and brush assembly 30 under the doffing brush 21. This causes the seed reclaiming doffing brush to eject the reclaimed seed back into the plenum along a ballistic trajectory that reinforces, not negates, the main seed cotton entry trajectory, thus causing co-current air and seed lock flows.

It should be clear from the forgoing that the present invention provides an unequaled separation of the seed cotton and a dispersal technique unlike any known feeder for cage gins. That is to say this invention provides for ballistic air separation rather than mere lifting of the cotton by air currents. The energization of the cotton as it passes between that doffing brush and the saw into a large volume plenum where the energy may be dissipated due to the variable nature of the locks themselves allows for virtual single locking and for superior opening of the cotton locks such that the fibers are more fully exposed to the action of the cage gin. Further, as the surface of the cage roller becomes filled, the transient air currents seek the path of least resistance through uncovered or open spaces on the cage and influence the airborne locks to the open spaces on the surface thereby facilitating maximum disbursal of the seed cotton for a more uniform application of the seed cotton to the cage surface. In addition, as the already opened seed locks approach the ⅛" (0.32) spaces between the ¾" (1.95) cage rollers, the air velocity increases and tends to draw the longer fibers into the spaces ahead of the gravitational pull on the heavier seed. Thus, a fringe of the longer fibers more efficiently projects down through the cage rollers facilitating the interaction with the nip rollers.

While I have shown my invention in one form, it will be obvious to those skilled in the art that it is not so limited but is susceptible of various changes and modifications without departing from the spirit thereof.

What I claim is:

1. In a cage gin for separating fibers from seed cotton wherein an annulus of closely spaced rollers is driven about an axis of said annulus and a suction means within said annulus for drawing air between said closely spaced rollers in combination with at least one nip roller abutting the interior of said annulus to engage fibers from said seed cotton between said nip roller and said closely spaced rollers to remove the fibers from the seed, the improvement comprising:

(a) a housing defining a plenum about said annulus and defining means for selectively admitting air into said plenum; and, (b) means for injecting seed cotton into said plenum along a ballistic trajectory which carries said seed cotton over the uppermost portion of said annulus to disperse said seed cotton on said annulus.

2. The improvement as defined in claim 1 wherein said means for injecting comprises at least one rotating elongated member adapted to receive seed cotton on a first side thereof such that individual locks of seed cotton are ballistically propelled into said plenum through an opening in said housing extending along said member.

3. The improvement as defined in claim 2 wherein said at least one rotating member is a doffing brush cylinder.

4. The improvement as defined in claim 2 wherein said rotating member is adapted to propel said seed cotton along an initial plane which would extend upwardly at an angle of about 20 degrees above horizontal.

5. The improvement as defined in claim 2 wherein said means for selectively admitting air to said plenum is located on said housing subjacent said means for injecting.

6. The improvement as defined in claim 5 wherein said means for selectively admitting air into said plenum comprises at least one perforation in said housing providing fluid communication between said plenum and the ambient air externally of said housing.

7. The improvement as defined in claim 6 further comprising baffle means for varying the air flow through said perforation.

8. The improvement as defined in claim 1 wherein said means for injecting comprises elongated rotating members which are offset from each other such that a plane tangent the opposing surfaces thereof along which seed cotton is ballistically propelled by said rotating members would extend upwardly at an angle of about 20 degrees to about 45 degrees above horizontal.

9. The improvement as defined in claim 1 wherein said means for selectively admitting air into said plenum comprises at least one perforation in said housing providing fluid communication between said plenum and the ambient air externally of said housing.

10. The improvement as defined in claim 9 further comprising baffle means for varying the air flow through said perforation.

11. The improvement as defined in claim 10 wherein said housing extends from said injecting means upwardly over said annulus and curves downwardly to a side thereof opposite said injecting means forming a collection slide such that seed cotton locks injected into said housing beyond said annulus are directed to said annulus thereby.

12. The improvement as defined in claim 1, wherein said annulus of closely spaced rollers rotates toward said injecting means such that said trajectories of said seed cotton are counter to said rotation of an uppermost surface of said annulus.

13. The improvement as defined in claim 1, wherein said improvement further comprises means for reclaiming said seed cotton, said reclaiming means located subjacent to said injecting means.

14. In a cage gin for separating fibers from seed cotton wherein an annulus of closely spaced rollers is driven in a first direction about an axis of said annulus and a suction means within said annulus for drawing air between said closely spaced rollers in combination with at least one nip roller abutting the interior of said annulus to engage fibers from said seed cotton between said nip roller and said closely spaced rollers to remove the fibers from the seed, the improvement comprising:

(a) a housing defining a plenum about said annulus; and, (b) means for injecting seed cotton into said plenum along a ballistic trajectory which carries said seed cotton in a direction opposite said first direction co-current with air currents drawn into said plenum over the uppermost portion of said annulus to disperse said seed cotton on said annulus.

15. The improvement as defined in claim 14 wherein said mean for injecting comprises a pair of oppositely rotating elongated members adapted to receive seed cotton on a first side thereof to urge said cotton between said members such that individual locks of seed cotton are ejected from between said members into said plenum through an opening in said housing extending along the interstice between said members.

16. The improvement as defined in claim 15 wherein said rotating members are offset from each other such that a plane tangent the opposing surfaces thereof would extend upwardly at an angle of about 20 degrees to about 45 degrees above horizontal.

17. The improvement as defined in claim 15 wherein said housing extends from said injecting means upwardly over said annulus and curves downwardly to a side thereof opposite said injecting means forming a collection slide such that seed cotton locks injected into said housing beyond said annulus are directed to said annulus thereby.

18. The improvement as defined in claim 14, wherein said improvement further comprises means for reclaiming said seed cotton, said reclaiming means located subjacent to said injecting means.

19. A method for dispersing seed cotton onto a roller gin having a plurality of rollers mounted on a rotating ring with each roller of said plurality sequentially abutting at least one stationary nip roller mounted within said ring, comprising the steps of:

(a) creating an air flow from externally of said plurality of rollers to the interior of said plurality of rollers within a housing surrounding said plurality of rollers, (b) injecting seed cotton into said housing along a ballistic trajectory which carries said seed cotton over the uppermost one of said plurality of rollers.

20. The method of claim 19 wherein said injecting step comprises urging said seed cotton between a pair of high speed rollers such that said seed cotton is ejected from between said rollers rapidly and dispersively along said ballistic trajectory.

21. The method of claim 20 further comprising admitting air into said housing subjacent said rollers such that an air flow is set up in co-current flow with said cotton along said ballistic trajectory.

* * * * *

UNITED STATES PATENT AND TRADEMARK OFFICE

CERTIFICATE OF CORRECTION

PATENT NO. : 5,740,588

DATED : April 21, 1998

INVENTOR(S) : Leo Strick

It is certified that error appears in the above-identified patent and that said Letters Patent is hereby corrected as shown below:

Column 1, line 45, delete "second" and insert --seed--
Column 1, line 49, delete "roller" and insert --rollers--
Column 1, line 57, delete "roller" and insert --rollers--
Column 1, line 63, delete "roller" and insert --rollers--
Column 1, line 66, delete "about" and insert --above--
Column 1, line 66, delete "roller" and insert --rollers--
Column 2, line 31, delete "about" and insert --above--
Column 3, line 66, delete "1.95" and insert --1.91--
Column 5, line 29, delete "mean" and insert --means--

Signed and Sealed this

Fifteenth Day of December, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,740,588

DATED : April 21, 1998

INVENTOR(S) : Leo Strick

It is certified that error appears in the above-identified patent and that said Letters Patent is hereby corrected as shown below:

Column 1, line 45, delete "second" and insert --seed--

Column 1, line 49, delete "roller" and insert --rollers--

Column 1, line 57, delete "roller" and insert --rollers--

Column 1, line 63, delete "roller" and insert --rollers--

Column 1, line 66, delete "about" and insert --above--

Column 1, line 66, delete "roller" and insert --rollers--

Column 2, line 31, delete "about" and insert --above--

Column 3, line 66, delete "1.95" and insert --1.91--

IN THE CLAIMS:

Column 5, line 29, delete "mean" and insert --means--

Signed and Sealed this

Eighteenth Day of May, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,740,588
DATED : April 21, 1998
INVENTOR(S) : Leo Strick

It is certified that error appears in the above-identified patent and that said Letters Patent is hereby corrected as shown below:

Title page,
Showing the illustrative figure should be deleted to be replaced with the attached title page.

Drawings,
Drawing sheet, consisting of Fig. 1, should be deleted to be replaced with the Drawing Sheet, consisting of Fig. 1, as shown on the attached page.

Column 1,
Line 45, delete “second” and insert -- seed --
Line 49, delete “roller” and insert -- rollers --
Line 57, delete “roller” and insert -- rollers --
Line 63, delete “roller” and insert -- rollers --
Line 66, delete “about” and insert -- above --
Line 66, delete “roller” and insert -- rollers --

Column 2,
Line 31, delete “about” and insert -- above --

Column 3,
Line 66, delete “1.95” and insert -- 1.91 --

Column 5,
Line 29, delete “mean” and insert -- means --

Signed and Sealed this

Sixteenth Day of July, 2002

*Attest:*

*Attesting Officer*

JAMES E. ROGAN
*Director of the United States Patent and Trademark Office*

United States Patent [19]

Strick

[11] Patent Number: 5,740,588

[45] Date of Patent: Apr. 21, 1998

[54] CAGE GIN FEEDING APPARATUS AND METHOD

[75] Inventor: Leo Strick, Greenville, S.C.

[73] Assignee: Lummus Corporation, Columbus, Ga.

[21] Appl. No.: 366,620

[22] Filed: Dec. 30, 1994

[51] Int. Cl.[6] ..... D01B 1/06

[52] U.S. Cl. ..... 19/48 R; 19/64.5

[58] Field of Search ..... 19/58, 59, 60, 19/48 R, 64.5, 41, 44, 42, 40, 39, 53, 50

[56] References Cited

U.S. PATENT DOCUMENTS

| | | | |
|---|---|---|---|
| 88,464 | 3/1869 | Emery | 19/60 |
| 1,201,901 | 10/1916 | West | 19/58 |
| 1,220,959 | 3/1917 | Cox | 19/58 |
| 1,276,355 | 8/1918 | Henry | 19/58 |
| 1,375,985 | 4/1921 | Vardell | 19/58 |
| 1,375,986 | 4/1921 | Vardell | 19/58 |
| 4,441,232 | 4/1984 | Underbrink et al. | 19/48 R |
| 4,934,029 | 6/1990 | Wilkes et al. | 19/48 R |

*Primary Examiner*—Ismael Izaguirre
*Attorney, Agent, or Firm*—Veal & Marsh

[57] ABSTRACT

Maximum separation of the seed cotton locks delivered to a cage roller gin is achieved by a ballistic trajectory that carries the locks over the top of the cage roller to a landing area. In the preferred embodiment, the flight of the locks over the cage roller is induced by a pair of oppositely driven rollers which expel the cotton from between their adjacent surfaces along a common tangential plane offset at an angle above the top of the cage roller. Ambient air is admitted to the relatively large volume plenum from beneath the rollers and a primary flow of air about the cage roller is promoted as the seed cotton overlies the rotating cage such that the air and injected seed cotton locks flow in co-current direction above the cage roller.

21 Claims, 1 Drawing Sheet

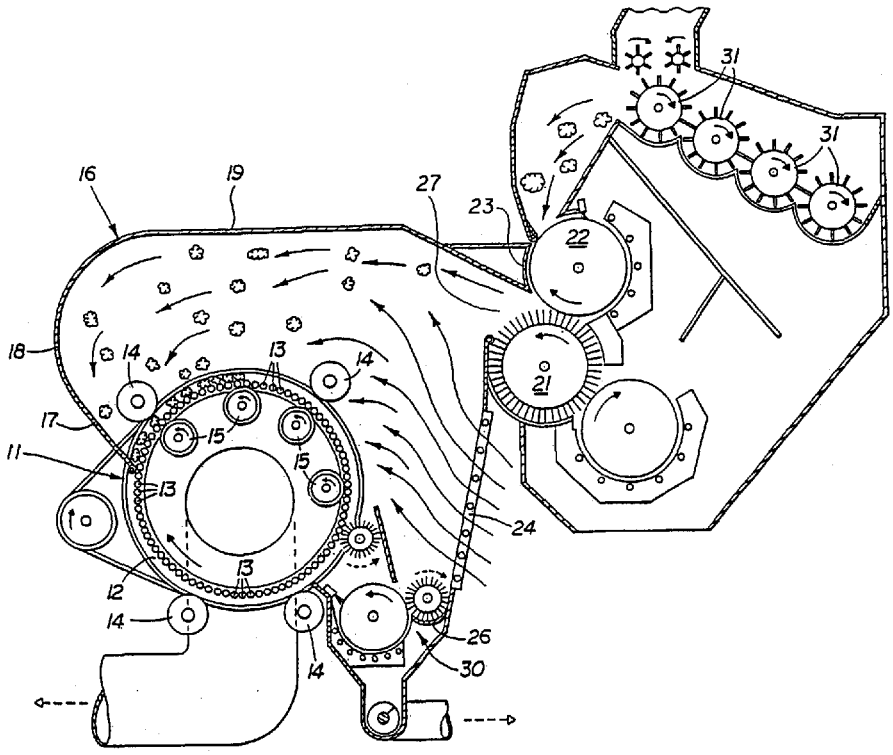

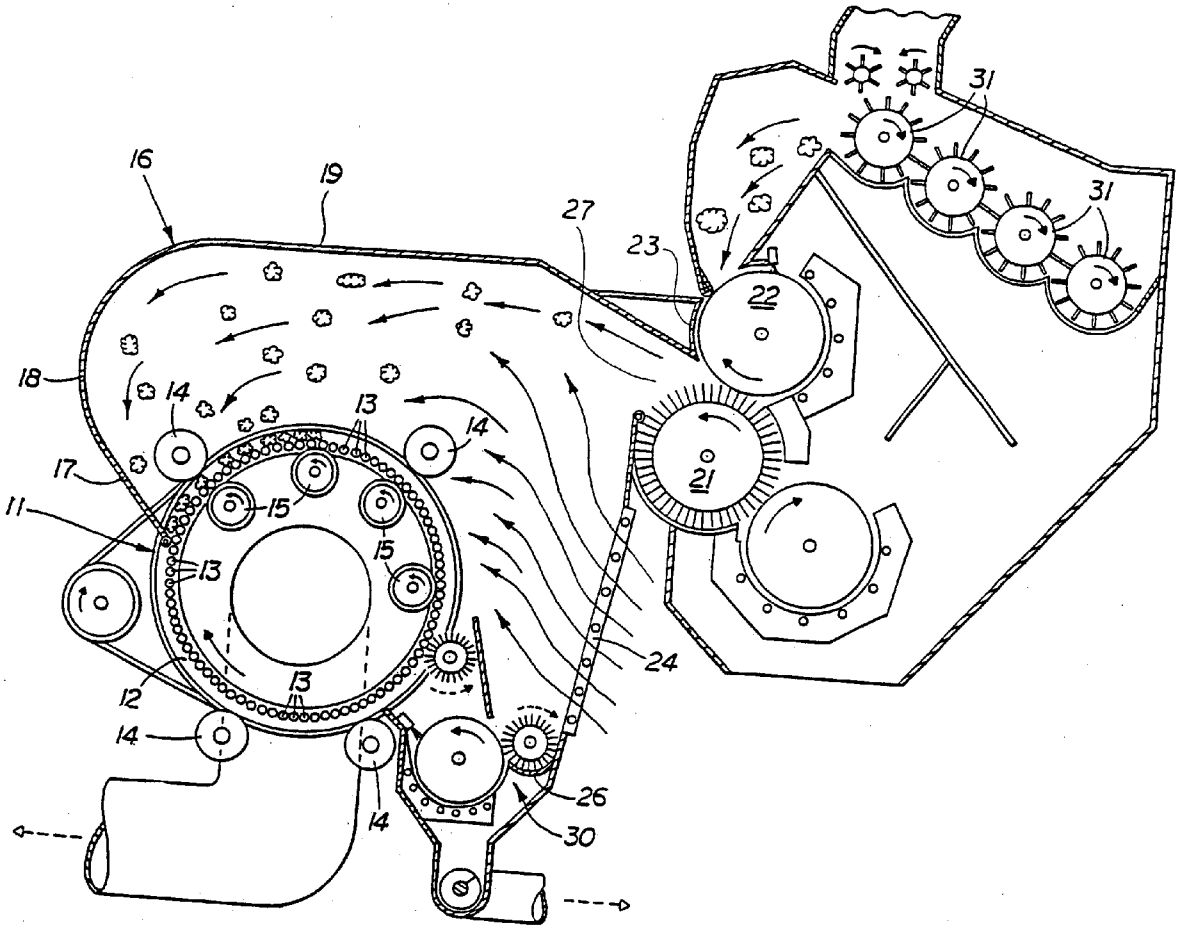

U.S. Patent Apr. 21, 1998 5,740,588